US009725853B2

(12) United States Patent
Ramaratnam et al.

(10) Patent No.: US 9,725,853 B2
(45) **Date of Patent: *Aug. 8, 2017**

(54) SOFT THROUGH AIR DRIED TISSUE

(71) Applicant: FIRST QUALITY TISSUE, LLC, Great Neck, NY (US)

(72) Inventors: Karthik Ramaratnam, Anderson, SC (US); Byrd Tyler Miller, IV, Easley, SC (US); Shane Ervin Hayes, Anderson, SC (US); James E. Sealey, II, Belton, SC (US)

(73) Assignee: FIRST QUALITY TISSUE, LLC, Great Neck, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/443,885

(22) Filed: Feb. 27, 2017

(65) Prior Publication Data

US 2017/0167082 A1 Jun. 15, 2017

Related U.S. Application Data

(60) Continuation of application No. 15/170,746, filed on Jun. 1, 2016, now Pat. No. 9,580,872, which is a continuation of application No. 14/534,631, filed on Nov. 6, 2014, now Pat. No. 9,382,666, which is a division of application No. 13/837,685, filed on Mar. 15, 2013, now Pat. No. 8,968,517.

(60) Provisional application No. 61/679,337, filed on Aug. 3, 2012.

(51) Int. Cl.

| | |
|---|---|
| ***D21H 27/00*** | (2006.01) |
| ***D21H 27/38*** | (2006.01) |
| ***D21H 27/40*** | (2006.01) |
| ***D21H 21/20*** | (2006.01) |

(52) U.S. Cl.

CPC ..... *D21H 27/38* (2013.01); *D21H 21/20* (2013.01); *D21H 27/004* (2013.01); *D21H 27/40* (2013.01)

(58) Field of Classification Search

CPC ..... D21H 27/00; D21H 27/38; D21H 27/40
USPC ..... 162/127
See application file for complete search history.

(56) References Cited

U.S. PATENT DOCUMENTS

| | | | |
|---|---|---|---|
| 3,911,173 | A | 10/1975 | Sprague, Jr. |
| 3,994,771 | A | 11/1976 | Morgan, Jr. et al. |
| 4,098,632 | A | 7/1978 | Sprague, Jr. |
| 4,102,737 | A | 7/1978 | Morton |
| 4,191,609 | A | 3/1980 | Trokhan |
| 4,529,480 | A | 7/1985 | Trokhan |
| 4,678,590 | A | 7/1987 | Nakamura et al. |
| 4,770,920 | A | 9/1988 | Larsonneur |
| 4,885,202 | A | 12/1989 | Lloyd et al. |
| 4,891,249 | A | 1/1990 | McIntyre |
| 4,949,668 | A | 8/1990 | Heindel et al. |
| 4,996,091 | A | 2/1991 | McIntyre |
| 5,059,282 | A | 10/1991 | Ampulski et al. |
| 5,143,776 | A | 9/1992 | Givens |
| 5,405,501 | A | 4/1995 | Phan et al. |
| 5,487,313 | A | 1/1996 | Johnson |
| 5,510,002 | A | 4/1996 | Hermans et al. |
| 5,529,665 | A | 6/1996 | Kaun |
| 5,581,906 | A | 12/1996 | Ensign et al. |
| 5,607,551 | A | 3/1997 | Farrington, Jr. et al. |
| 5,635,028 | A | 6/1997 | Vinson et al. |
| 5,671,897 | A | 9/1997 | Ogg et al. |
| 5,728,268 | A | 3/1998 | Weisman et al. |
| 5,772,845 | A | 6/1998 | Farrington, Jr. et al. |
| 5,827,384 | A | 10/1998 | Canfield et al. |
| 5,832,962 | A | 11/1998 | Kaufman et al. |
| 5,846,380 | A | 12/1998 | Van Phan et al. |
| 5,855,738 | A | 1/1999 | Weisman et al. |
| 5,858,554 | A | 1/1999 | Neal et al. |
| 5,865,396 | A | 2/1999 | Ogg et al. |
| 5,865,950 | A | 2/1999 | Vinson et al. |
| 5,942,085 | A | 8/1999 | Neal et al. |
| 5,944,954 | A | 8/1999 | Vinson et al. |
| 5,980,691 | A | 11/1999 | Weisman et al. |
| 6,036,139 | A | 3/2000 | Ogg |
| 6,048,938 | A | 4/2000 | Neal et al. |
| 6,106,670 | A | 8/2000 | Weisman et al. |
| 6,149,769 | A | 11/2000 | Mohammadi et al. |
| 6,162,327 | A | 12/2000 | Batra et al. |
| 6,162,329 | A | 12/2000 | Vinson et al. |
| 6,187,138 | B1 | 2/2001 | Neal et al. |
| 6,203,667 | B1 | 3/2001 | Huhtelin |
| 6,207,734 | B1 | 3/2001 | Vinson et al. |
| 6,319,362 | B1 | 11/2001 | Huhtelin |
| 6,344,111 | B1 | 2/2002 | Wilhelm |
| 6,420,013 | B1 | 7/2002 | Vinson et al. |
| 6,423,184 | B2 | 7/2002 | Vahatalo |
| 6,464,831 | B1 | 10/2002 | Trokhan et al. |
| 6,473,670 | B1 | 10/2002 | Huhtelin |
| 6,521,089 | B1 | 2/2003 | Griech |

(Continued)

FOREIGN PATENT DOCUMENTS

| | | | |
|---|---|---|---|
| WO | 96/06223 | A1 | 2/1996 |
| WO | 2007070145 | A1 | 6/2007 |

(Continued)

OTHER PUBLICATIONS

U.S. Appl. No. 15/170,760, filed Jun. 1, 2016.

(Continued)

*Primary Examiner* — Mark Halpern
(74) *Attorney, Agent, or Firm* — Amster, Rothstein 7 Ebenstein LLP

(57) ABSTRACT

A multi-layer through air dried tissue including a first exterior layer comprised substantially of hardwood fibers, an interior layer comprised substantially of softwood fibers, and a second exterior layer comprised substantially of hardwood fibers. The interior layer includes a first wet end additive comprising an ionic surfactant and a second wet end additive comprising a non-ionic surfactant.

13 Claims, 3 Drawing Sheets

(56) References Cited

U.S. PATENT DOCUMENTS

| | | | |
|---|---|---|---|
| 6,547,928 | B2 | 4/2003 | Barnholtz et al. |
| 6,551,453 | B2 | 4/2003 | Weisman et al. |
| 6,572,722 | B1 | 6/2003 | Pratt |
| 6,579,416 | B1 | 6/2003 | Vinson et al. |
| 6,607,637 | B1 | 8/2003 | Vinson et al. |
| 6,673,202 | B2 | 1/2004 | Burazin |
| 6,755,939 | B2 | 6/2004 | Vinson et al. |
| 6,797,117 | B1 | 9/2004 | McKay et al. |
| 6,808,599 | B2 | 10/2004 | Burazin |
| 6,821,386 | B2 | 11/2004 | Weisman et al. |
| 6,821,391 | B2 | 11/2004 | Scherb et al. |
| 6,827,818 | B2 | 12/2004 | Farrington, Jr. et al. |
| 6,998,024 | B2 | 2/2006 | Burazin |
| 7,235,156 | B2 | 6/2007 | Baggot |
| 7,311,853 | B2 | 12/2007 | Vinson et al. |
| 7,351,307 | B2 | 4/2008 | Scherb et al. |
| 7,387,706 | B2 | 6/2008 | Herman et al. |
| 7,399,378 | B2 | 7/2008 | Edwards et al. |
| 7,419,569 | B2 | 9/2008 | Hermans |
| 7,427,434 | B2 | 9/2008 | Busam |
| 7,431,801 | B2 | 10/2008 | Conn et al. |
| 7,432,309 | B2 | 10/2008 | Vinson |
| 7,442,278 | B2 | 10/2008 | Murray et al. |
| 7,476,293 | B2 | 1/2009 | Herman et al. |
| 7,494,563 | B2 | 2/2009 | Edwards et al. |
| 7,510,631 | B2 | 3/2009 | Scherb et al. |
| 7,563,344 | B2 | 7/2009 | Beuther |
| 7,582,187 | B2 | 9/2009 | Scherb et al. |
| 7,622,020 | B2 | 11/2009 | Awofeso |
| 7,662,462 | B2 | 2/2010 | Noda |
| 7,683,126 | B2 | 3/2010 | Neal et al. |
| 7,686,923 | B2 | 3/2010 | Scherb et al. |
| 7,687,140 | B2 | 3/2010 | Manifold et al. |
| 7,691,230 | B2 | 4/2010 | Scherb et al. |
| 7,744,722 | B1 | 6/2010 | Tucker et al. |
| 7,744,726 | B2 | 6/2010 | Scherb et al. |
| 7,867,361 | B2 | 1/2011 | Salaam et al. |
| 7,905,989 | B2 | 3/2011 | Scherb et al. |
| 7,931,781 | B2 | 4/2011 | Scherb et al. |
| 7,951,269 | B2 | 5/2011 | Herman et al. |
| 7,955,549 | B2 | 6/2011 | Noda |
| 7,972,475 | B2 | 7/2011 | Chan et al. |
| 7,989,058 | B2 | 8/2011 | Manifold et al. |
| 8,034,463 | B2 | 10/2011 | Leimbach et al. |
| 8,075,739 | B2 | 12/2011 | Scherb et al. |
| 8,092,652 | B2 | 1/2012 | Scherb et al. |
| 8,118,979 | B2 | 2/2012 | Herman et al. |
| 8,147,649 | B1 | 4/2012 | Tucker et al. |
| 8,196,314 | B2 | 6/2012 | Munch |
| 8,303,773 | B2 | 11/2012 | Scherb et al. |
| 8,382,956 | B2 | 2/2013 | Boechat et al. |
| 8,402,673 | B2 | 3/2013 | Da Silva et al. |
| 8,435,384 | B2 | 5/2013 | Da Silva et al. |
| 8,440,055 | B2 | 5/2013 | Scherb et al. |
| 8,544,184 | B2 | 10/2013 | Da Silva et al. |
| 8,574,211 | B2 | 11/2013 | Morita |
| 8,580,083 | B2 | 11/2013 | Boechat et al. |
| 8,968,517 | B2 | 3/2015 | Ramaratnam |
| 9,095,477 | B2 | 8/2015 | Yamaguchi |
| 9,382,666 | B2 | 7/2016 | Ramaratnam |
| 2001/0018068 | A1 | 8/2001 | Lorenzi et al. |
| 2002/0028230 | A1 | 3/2002 | Eichhorn et al. |
| 2003/0056917 | A1 | 3/2003 | Jimenez |
| 2004/0118531 | A1 | 6/2004 | Shannon et al. |
| 2004/0234804 | A1 | 11/2004 | Liu et al. |
| 2005/0016704 | A1 | 1/2005 | Huhtelin |
| 2005/0112115 | A1 | 5/2005 | Khan |
| 2007/0020315 | A1 | 1/2007 | Shannon et al. |
| 2009/0020248 | A1 | 1/2009 | Sumnicht et al. |
| 2009/0056892 | A1 | 3/2009 | Rekoske |
| 2009/0061709 | A1 | 3/2009 | Nakai et al. |
| 2011/0253329 | A1 | 10/2011 | Manifold et al. |
| 2015/0059995 | A1 | 3/2015 | Ramartnam et al. |
| 2016/0273168 | A1 | 9/2016 | Ramaratnam |

FOREIGN PATENT DOCUMENTS

| | | | |
|---|---|---|---|
| WO | 2011028823 | A1 | 3/2011 |
| WO | 2014/022848 | A1 | 2/2014 |

OTHER PUBLICATIONS

International Search Report of PCT/US13/53593 dated Dec. 20, 2013.

Written Opinion of PCT/US13/53593 dated Dec. 20, 2013.

International Preliminary Report on Patentability of PCT/US2013/053593 dated Feb. 3, 2015.

Supplementary European Search Report of EP 13 82 6461 Dated Apr. 1, 2016.

U.S. Appl. No. 61/679,337, filed Aug. 3, 2012.

U.S. Appl. No. 15/148,851, filed May 6, 2016.

SOFT THROUGH AIR DRIED TISSUE

RELATED APPLICATION

This application is a continuation of U.S. patent application Ser. No. 15/170,746, filed Jun. 1, 2016, which is a continuation of U.S. patent application Ser. No. 14/534,631, filed Nov. 6, 2014, now U.S. Pat. No. 9,382,666, which in turn is a divisional of U.S. patent application Ser. No. 13/837,685, filed Mar. 15, 2013, now U.S. Pat. No. 8,968,517, which in turn is based on and claims priority to U.S. Provisional Application No. 61/679,337, filed Aug. 3, 2012, and the contents of these applications are incorporated herein by reference in their entirety.

FIELD OF THE INVENTION

The present invention is directed to tissue, and in particular to a multilayer tissue including wet end additives.

BACKGROUND

According to conventional tissue-making processes, a slurry of pulp mixture is fed to a headbox, where the mixture is laid onto a forming surface so as to form a web. The web is then dried using pressure and/or heat to form the finished tissue. Prior to drying, the pulp mixture is considered to be in the "wet end" of the tissue making process. Additives may be used in the wet end to impart a particular attribute or chemical state to the tissue. However, using additives in the wet end has some disadvantages. For example, a large amount of additive may be required in the pulp mixture to achieve the desired effect on the finished tissue, which in turn leads to increased cost and, in the case of wet end additive debonder, may actually reduce the tissue strength. In order to avoid drawbacks associated with wet end additives, agents, such as softeners, have been added topically after web formation.

The tissue web may be dried by transferring the web to a forming surface and then directing a flow of heated air onto the web. This process is known as through air drying (TAD). While topical softeners have been used in combination with through air dried tissue, the resulting products have had a tamped down or flattened surface profile. The flattened surface profile in turn hinders the cleaning ability of the tissue and limits the overall effectiveness of the softener.

SUMMARY OF THE INVENTION

An object of the present invention is to provide a tissue manufacturing method that uses through air drying without compromising softness and cleaning ability of the resulting tissue.

Another object of the present invention is to provide a tissue manufacturing method that avoids the disadvantages associated with wet end additives, and in particular avoids the use of a large amount of additive to achieve the desired effect on the resulting tissue.

A multi-layer through air dried tissue according to an exemplary embodiment of the present invention comprises a first exterior layer, an interior layer and a second exterior layer. The interior layer includes a first wet end additive comprising an ionic surfactant and a second wet end additive comprising a non-ionic surfactant.

A multi-layer through air dried tissue according to another exemplary embodiment of the present invention comprises a first exterior layer comprised substantially of hardwood fibers, an interior layer comprised substantially of softwood fibers, and a second exterior layer comprised substantially of hardwood fibers. The interior layer includes a first wet end additive comprising an ionic surfactant and a second wet end additive comprising a non-ionic surfactant.

In at least one exemplary embodiment, the first exterior layer further comprises a wet end temporary wet strength additive.

In at least one exemplary embodiment, the first exterior layer further comprises a wet end dry strength additive.

In at least one exemplary embodiment, the second exterior layer further comprises a wet end dry strength additive.

In at least one exemplary embodiment, the second wet end additive comprises an ethoxylated vegetable oil.

In at least one exemplary embodiment, the second wet end additive comprises a combination of ethoxylated vegetable oils.

In at least one exemplary embodiment, the ratio by weight of the second wet end additive to the first wet end additive in the tissue is at least eight to one.

In at least one exemplary embodiment, the ratio by weight of the second wet end additive to the first wet end additive in the first interior layer is at most ninety to one.

In at least one exemplary embodiment, the tissue has a softness (hand feel) of at least 90.

In at least one exemplary embodiment, the tissue has a bulk softness of less than 10 TS7.

In at least one exemplary embodiment, the ionic surfactant comprises a debonder.

In at least one exemplary embodiment, the tissue has a tensile strength of at least 35 N/m, a softness of at least 90 and a basis weight of less than 25 gsm.

In at least one exemplary embodiment, the tissue has a tensile strength of at least 35 N/m, a softness of at least 90 and a caliper of less than 650 microns.

In at least one exemplary embodiment, the wet end temporary wet strength additive comprises glyoxalated polyacrylamide.

In at least one exemplary embodiment, the wet end dry strength additive comprises amphoteric starch.

In at least one exemplary embodiment, the first exterior layer further comprises a dry strength additive.

In at least one exemplary embodiment, the first and second exterior layers are substantially free of any surface deposited softener agents or lotions.

In at least one exemplary embodiment, at least one of the first or second exterior layers comprises a surface deposited softener agent or lotion.

In at least one exemplary embodiment, the tissue has a softness of at least 95.

In at least one exemplary embodiment, the non-ionic surfactant has a hydrophilic-lipophilic balance of less than 10, and preferably less than 8.5.

In at least one exemplary embodiment, the tissue may have a softness of at least 95.

In at least one exemplary embodiment, the first exterior layer is comprised of at least 75% by weight of hardwood fibers.

In at least one exemplary embodiment, the interior layer is comprised of at least 75% by weight of softwood fibers.

Other features and advantages of embodiments of the invention will become readily apparent from the following detailed description, the accompanying drawings and the appended claims.

BRIEF DESCRIPTION OF THE DRAWINGS

Exemplary embodiments of the present invention will be described with references to the accompanying figures, wherein.

DETAILED DESCRIPTION

The present invention is directed to a soft tissue made with a combination of a wet end added ionic surfactant and a wet end added nonionic surfactant. The tissue may be made up of a number of layers, including exterior layers and an interior layer. In at least one exemplary embodiment, pulp mixes for each tissue layer are prepared individually.

Figure 1:
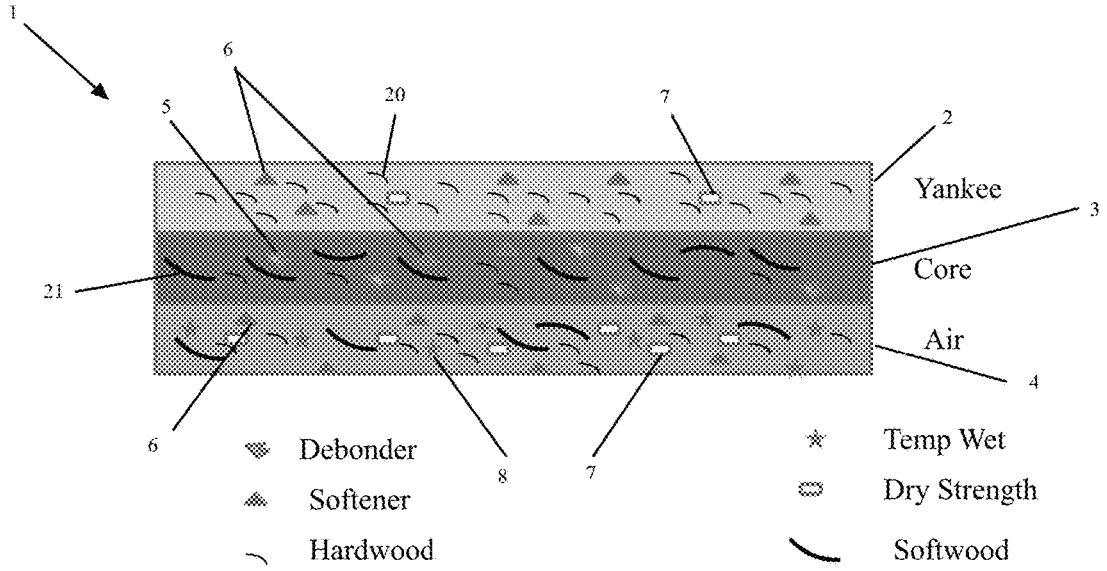
FIG. 1 is a schematic diagram of a three layer tissue in accordance with an exemplary embodiment of the present invention.

FIG. 1 shows a three layer tissue, generally designated by reference number 1, according to an exemplary embodiment of the present invention. The tissue 1 has external layers 2 and 4 as well as an internal, core layer 3. External layer 2 is composed primarily of hardwood fibers 20 whereas external layer 4 and core layer 3 are composed of a combination of hardwood fibers 20 and softwood fibers 21. The internal core layer 3 includes an ionic surfactant functioning as a debonder 5 and a non-ionic surfactant functioning as a softener 6. As explained in further detail below, external layers 2 and 4 also include non-ionic surfactant that migrated from the internal core layer 3 during formation of the tissue 1. External layer 2 further includes a dry strength additive 7. External layer 4 further includes both a dry strength additive 7 and a temporary wet strength additive 8.

Pulp mixes for exterior layers of the tissue are prepared with a blend of primarily hardwood fibers. For example, the pulp mix for at least one exterior layer is a blend containing about 70 percent or greater hardwood fibers relative to the total percentage of fibers that make up the blend. As a further example, the pulp mix for at least one exterior layer is a blend containing about 90-100 percent hardwood fibers relative to the total percentage of fibers that make up the blend.

Pulp mixes for the interior layer of the tissue are prepared with a blend of primarily softwood fibers. For example, the pulp mix for the interior layer is a blend containing about 70 percent or greater softwood fibers relative to the total percentage of fibers that make up the blend. As a further example, the pulp mix for the interior layer is a blend containing about 90-100 percent softwood fibers relative to the total percentage of fibers that make up the blend.

As known in the art, pulp mixes are subjected to a dilution stage in which water is added to the mixes so as to form a slurry. After the dilution stage but prior to reaching the headbox, each of the pulp mixes are dewatered to obtain a thick stock of about 95% water. In an exemplary embodiment of the invention, wet end additives are introduced into the thick stock pulp mixes of at least the interior layer. In an exemplary embodiment, a non-ionic surfactant and an ionic surfactant are added to the pulp mix for the interior layer. Suitable non-ionic surfactants have a hydrophilic-lipophilic balance of less than 10, and preferably less than or equal to 8.5. An exemplary non-ionic surfactant is an ethoxylated vegetable oil or a combination of two or more ethoxylated vegetable oils. Other exemplary non-ionic surfactants include ethylene oxide, propylene oxide adducts of fatty alcohols, alkylglycoside esters, and alkylethoxylated esters.

Suitable ionic surfactants include but are not limited to quaternary amines and cationic phospholipids. An exemplary ionic surfactant is 1,2-di(heptadecyl)-3-methyl-4,5-dihydroimidazol-3-ium methyl sulfate. Other exemplary ionic surfactants include (2-hydroxyethyl)methylbis[2-[(1-oxooctadecyl)oxy]ethyl]ammonium methyl sulfate, fatty dialkyl amine quaternary salts, mono fatty alkyl tertiary amine salts, unsaturated fatty alkyl amine salts, linear alkyl sulfonates, alkyl-benzene sulfonates and trimethyl-3-[(1-oxooctadecyl)amino]propylammonium methyl sulfate.

In an exemplary embodiment, the ionic surfactant may function as a debonder while the non-ionic surfactant functions as a softener. Typically, the debonder operates by breaking bonds between fibers to provide flexibility, however an unwanted side effect is that the overall strength of the tissue can be reduced by excessive exposure to debonder. Typical debonders are quaternary amine compounds such as trimethyl cocoammonium chloride, trymethyloleylammonium chloride, dimethyldi(hydrogenated-tallow)ammonium chloride and trimethylstearylammonium chloride.

After being added to the interior layer, the non-ionic surfactant (functioning as a softener) migrates through the other layers of the tissue while the ionic surfactant (functioning as a debonder) stays relatively fixed within the interior layer. Since the debonder remains substantially within the interior layer of the tissue, softer hardwood fibers (that may have lacked sufficient tensile strength if treated with a debonder) can be used for the exterior layers. Further, because only the interior of the tissue is treated, less debonder is required as compared to when the whole tissue is treated with debonder.

In an exemplary embodiment, the ratio of ionic surfactant to non-ionic surfactant added to the pulp mix for the interior layer of the tissue is between 1:4 and 1:90 parts by weight and preferably about 1:8 parts by weight. In particular, when the ionic surfactant is a quaternary amine debonder, reducing the concentration relative to the amount of non-ionic surfactant can lead to an improved tissue. Excess debonder, particularly when introduced as a wet end additive, can weaken the tissue, while an insufficient amount of debonder may not provide the tissue with sufficient flexibility. Because of the migration of the non-ionic surfactant to the exterior layers of the tissue, the ratio of ionic surfactant to non-ionic surfactant in the core layer may be significantly lower in the actual tissue compared to the pulp mix.

In an exemplary embodiment, a dry strength additive is added to the thick stock mix for at least one of the exterior layers. The dry strength additive may be, for example, amphoteric starch, added in a range of about 1 to 40 kg/ton. In another exemplary embodiment, a wet strength additive is added to the thick stock mix for at least one of the exterior layers. The wet strength additive may be, for example, glyoxalated polyacrylamide, commonly known as GPAM, added in a range of about 0.25 to 5 kg/ton. In a further exemplary embodiment, both a dry strength additive, preferably amphoteric starch and a wet strength additive, preferably GPAM are added to one of the exterior layers. Without being bound by theory, it is believed that the combination of both amphoteric starch and GPAM in a single layer when added as wet end additives provides a synergistic effect with regard to strength of the finished tissue. Other exemplary temporary wet-strength agents include aldehyde functionalized cationic starch, aldehyde functionalized polyacrylamides, acrolein co-polymers and cis-hydroxyl polysachharide (guar gum and locust bean gum) used in combination with any of the above mentioned compounds.

In addition to amphoteric starch, suitable dry strength additives may include but are not limited to glyoxalated polyacrylamide, cationic starch, carboxy methyl cellulose, guar gum, locust bean gum, cationic polyacrylamide, polyvinyl alcohol, anionic polyacrylamide or a combination thereof.

Figure 4:
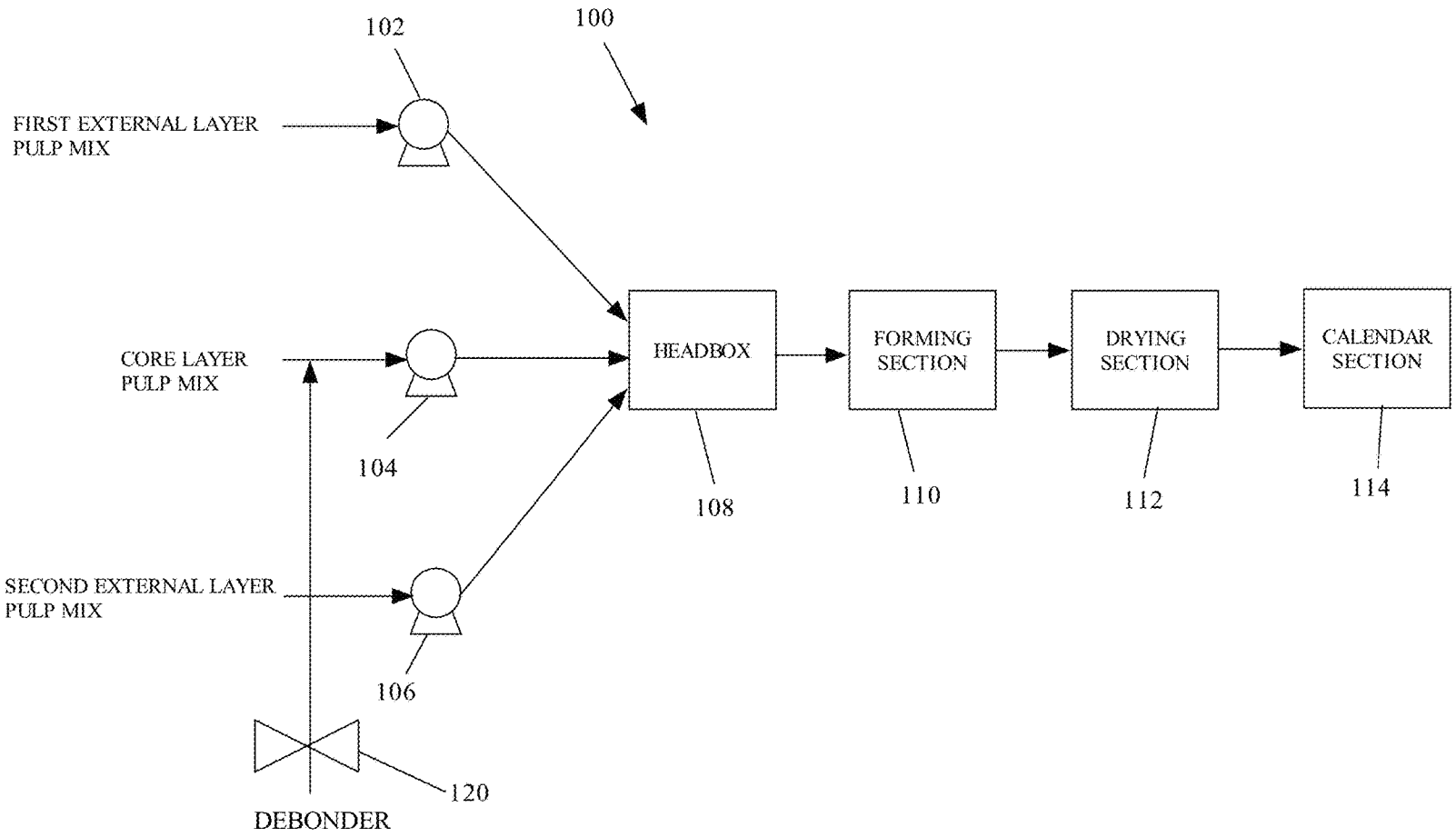
FIG. 4 is a block diagram of a system for manufacturing tissue according to an exemplary embodiment of the present invention.

FIG. 4 is a block diagram of a system for manufacturing tissue, generally designated by reference number 100, according to an exemplary embodiment of the present invention. The system 100 includes an first exterior layer fan pump 102, a core layer fan pump 104, a second exterior layer fan pump 106, a headbox 108, a forming section 110, a drying section 112 and a calendar section 114. The first and second exterior layer fan pumps 102, 106 deliver the pulp mixes of the first and second external layers 2, 4 to the headbox 108, and the core layer fan pump 104 delivers the pulp mix of the core layer 3 to the headbox 108. As is known in the art, the headbox delivers a wet web of pulp onto a forming wire within the forming section 110. The wet web is laid on the forming wire with the core layer 3 disposed between the first and second external layers 2, 4.

After formation in the forming section 110, the partially dewatered web is transferred to the drying section 112, Within the drying the section 112, the tissue of the present invention may be dried using conventional through air drying processes. In an exemplary embodiment, the tissue of the present invention is dried to a humidity of about 7 to 20% using a through air drier manufactured by Metso Corporation, of Helsinki, Finland. In another exemplary embodiment of the invention, two or more through air drying stages are used in series. Without being bound by theory, it is believed that the use of multiple drying stages improves uniformity in the tissue, thus reducing tears.

In an exemplary embodiment, the tissue of the present invention is patterned during the through air drying process. Such patterning can be achieved through the use of a TAD fabric, such as a G-weave (Prolux 003) or M-weave (Prolux 005) TAD fabric.

After the through air drying stage, the tissue of the present invention may be further dried in a second phase using a Yankee drying drum. In an exemplary embodiment, a creping adhesive is applied to the drum prior to the tissue contacting the drum. A creping blade is then used to remove the tissue from the Yankee drying drum. The tissue may then be calendered in a subsequent stage within the calendar section 114. According to an exemplary embodiment, calendaring may be accomplished using a number of calendar rolls (not shown) that deliver a calendering pressure in the range of 0-100 pounds per linear inch (PLI). In general, increased calendering pressure is associated with reduced caliper and a smoother tissue surface.

According to an exemplary embodiment of the invention, a ceramic coated creping blade is used to remove the tissue from the Yankee drying drum. Ceramic coated creping blades result in reduced adhesive build up and aid in achieving higher run speeds. Without being bound by theory, it is believed that the ceramic coating of the creping blades provides a less adhesive surface than metal creping blades and is more resistant to edge wear that can lead to localized spots of adhesive accumulation. The ceramic creping blades allow for a greater amount of creping adhesive to be used which in turn provides improved sheet integrity and faster run speeds.

In addition to the use of wet end additives, the tissue of the present invention may also be treated with topical or surface deposited additives. Examples of surface deposited additives include softeners for increasing fiber softness and skin lotions. Examples of topical softeners include but are not limited to quaternary ammonium compounds, including, but not limited to, the dialkyldimethylammonium salts (e.g. ditallowdimethylammonium chloride, ditallowdimethylammonium methyl sulfate, di(hydrogenated tallow)dimethyl ammonium chloride, etc.). Another class of chemical softening agents include the well-known organo-reactive polydimethyl siloxane ingredients, including amino functional polydimethyl siloxane. zinc stearate, aluminum stearate, sodium stearate, calcium stearate, magnesium stearate, spermaceti, and steryl oil.

The below discussed values for softness (i.e., hand feel (HF)), caliper and tensile strength of the inventive tissue were determined using the following test procedures:

Softness Testing

Softness of a tissue sheet was determined using a Tissue Softness Analyzer (TSA), available from emtec Electronic GmbH of Leipzig, Germany. A punch was used to cut out three 100 $cm^2$ round samples from the sheet. One of the samples was loaded into the TSA with the yankee side facing up. The sample was clamped in place and the TPII algorithm was selected from the list of available softness testing algorithms displayed by the TSA. After inputting parameters for the sample, the TSA measurement program was run. The test process was repeated for the remaining samples and the results for all the samples were averaged.

Caliper Testing

A Thwing-Albert ProGage 100 Thickness Tester, manufactured by Thwing Albert of West Berlin, N.J. was used for the caliper test. Eight 100 mm×100 mm square samples were cut from a base sheet. Each sample was folded over on itself, with the rougher layer, typically corresponding air layer facing itself. The samples were then tested individually and the results were averaged to obtain a caliper result for the base sheet.

Tensile Strength Testing

An Instron 3343 tensile tester, manufactured by Instron of Norwood, Mass., with a 100N load cell and 25.4 mm rubber coated jaw faces was used for tensile strength measurement. Prior to measurement, the Instron 3343 tensile tester was calibrated. After calibration, 8 strips, each one inch by eight inches, were provided as samples for testing. One of the sample strips was placed in between the upper jaw faces and clamp, and then between the lower jaw faces and clamp. A tensile test was run on the sample strip. The test procedure was repeated until all the samples were tested. The values obtained for the eight sample strips were averaged to determine the tensile strength of the tissue.

Tissue according to exemplary embodiments of the present invention has an improved softness as compared to conventional tissue. Specifically, the tissue of the present invention may have a softness or hand feel (HF) of at least 90. In another exemplary embodiment, the tissue of the present invention may have a softness of at least 95.

In another exemplary embodiment, the tissue has a bulk softness of less than 10 TS7 (as tested by a TSA). In an exemplary embodiment, the tissue of the present invention also has a basis weight for each ply of less than 22 grams per square meter. For such a soft, thin tissue the initial processing conditions may be defined so as to have a moisture content between 1.5 to 5%.

In another exemplary embodiment, the tissue of the present invention has a basis weight for each ply of at least 17 grams per square meter, more preferably at least 20 grams per square meter and most preferably at least 22 grams per square meter.

Tissue according to exemplary embodiments of the present invention has a good tensile strength in combination with improved softness and/or a lower basis weight or caliper as compared to conventional tissue. Without being bound by theory, it is believed that the process of the present invention allows the tissue to retain more strength, while still having superior softness without the need to increase the thickness or weight of the tissue. Specifically, the tissue of the present invention may have improved softness and/or strength while having a caliper of less than 650 microns.

Figure 2:
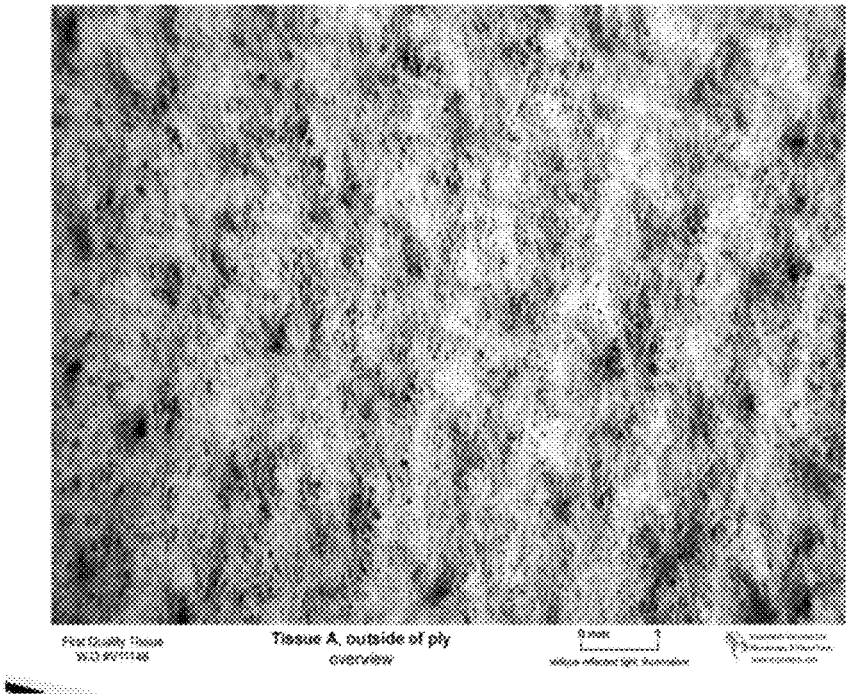
FIG. 2 shows a micrograph of the surface of a tissue according to an exemplary embodiment of the invention without a topical additive.
Figure 3:
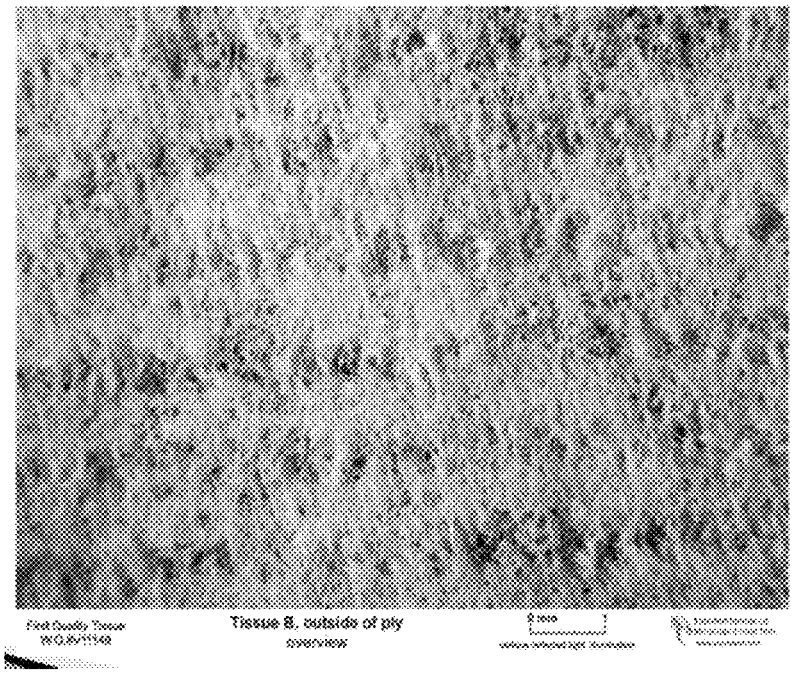
FIG. 3 shows a micrograph of the surface of a conventional through air dried tissue with a flattened surface texture.

Tissue according to exemplary embodiments of the present invention has a combination of improved softness with a high degree of uniformity of surface features. FIG. 2 shows a micrograph of the surface of a tissue according to an exemplary embodiment of the invention without a topical additive and FIG. 3 shows a micrograph of the surface of a conventional through air dried tissue with a flattened surface texture. The tissue of FIG. 2 has a high degree of uniformity in its surface profile, with regularly spaced features, whereas the tissue of FIG. 3 has flattened regions and a nonuniform profile.

The tissue of the present invention may also be calendered or treated with a topical softening agent to alter the surface profile. In exemplary embodiments, the surface profile can be made smoother by calendering or through the use of a topical softening agent. The surface profile may also be made rougher via microtexturing.

The following examples are provided to further illustrate the invention.

Example 1

Through air dried tissue was produced with a three layer headbox and a 005 Albany TAD fabric. The flow to each layer of the headbox was about 33% of the total sheet. The three layers of the finished tissue from top to bottom were labeled as air, core and dry. The air layer is the outer layer that is placed on the TAD fabric, the dry layer is the outer layer that is closest to the surface of the Yankee dryer and the core is the center section of the tissue. The tissue was produced with 45% *eucalyptus* fiber in the air layer, 50% *eucalyptus* fiber in the core layer and 100% *eucalyptus* fiber in the dry layer. Headbox pH was controlled to 7.0 by addition of a caustic to the thick stock before the fan pumps for all samples.

Roll size was about 10,000 meters long. The number of sheet-breaks per roll was determined by detecting the number of breaks in the sheet per every 10,000 meters of linear (MD-machine direction) sheet run.

The tissue according to Example 1 was produced with addition of a temporary wet strength additive, Hercobond 1194 (Ashland, 500 Hercules Road, Wilmington Del., 19808) to the air layer, a dry strength additive, Redibond 2038 (Corn Products, 10 Finderne Avenue, Bridgewater, N.J. 08807) split 75% to the air layer, 25% to the dry layer, and a softener/debonder, T526 (EKA Chemicals Inc., 1775 West Oak Commons Court, Marietta, Ga., 30062) added in combination to the core layer. The T526 is a softener/debonder combination with a quaternary amine concentration below 20%.

Example 2

Example 2 was produced with the same conditions as Example 1, but chemical addition rates were changed. Specifically, the amount of dry strength additive (Redibond 2038) was increased from 5.0 kg/ton to 10.0 kg/ton and the amount of softener/debonder (T526) was increased from 2.0 kg/ton to 3.6 kg/ton.

Example 3

Example 3 was produced with the same conditions as Example 1 except with T526 added to the dry layer.

Example 4

Example 4 was produced with the same conditions as Example 1 except for the addition of a debonder having a high quaternary amine concentration (>20%) to the core layer. The debonder was F509HA (manufactured by EKA Chemicals Inc., 1775 West Oak Commons Court, Marietta, Ga., 30062).

Comparative Example 1

Comparative Example 1 was produced with the same conditions as Example 1 except that wet end additives were not used Table 1 shows performance data and chemical dose information for the TAD basesheet of Examples 1-4 and Comparative Example 1. The basis weight (BW) of each Example was about 20.7 GSM.

TABLE 1

| Sample | HF[1] | MD/CD Tensile n/m[2] | Lint Value[3] | Hercobond D1194 kg/ton (temporary wet strength additive) | Redibond 2038 kg/ton (temporary dry strength additive) | EKA T526 kg/ton (Softener/ debonder) | Sheet-breaks per roll |
|---|---|---|---|---|---|---|---|
| Comparative Example 1 | 93.8 | 55/27 | 11.5 | 0 | 0 | 0 | 3 |
| Example 1 | 98.2 | 54/34 | 9.0 | 1.25 | 5.0 | 2.0 | 0 |
| Example 2 | 95.1 | 56/38 | 7.5 | 1.25 | 10 | 3.6 | 0 |
| Example 3 | 91.5 | 57/39 | 12.0 | 1.25 | 5.0 | 2.0 | 1 |
| Example 4 | 90.5 | 55/35 | 9.8 | 1.25 | 10 | 0.81 (F509HA) | 0 |

[1]All HF values are from single ply basesheet samples with dry side surface up.
[2]Basesheet single ply data.
[3]Post converted two ply product tested.

Examples 1 and 2 had a much higher hand-feel (HF) with lower lint value and improved machine efficiency compared to Comparative Example 1. Of note, these improved parameters were achieved while maintaining the same sheet MD/CD tensile range for both Examples 1 and 2 as in Comparative Example 1. The wet end chemical additives of Example 1 significantly improved product softness.

Example 2 is a further improvement over Example 1 with a reduced lint value. This improvement in Example 2 was achieved by increasing the Redibond 2038 and T526 dose.

Softness as determined by the TSA was significantly reduced when softener/debonder was added to the dry layer (Example 3) and when a tissue debonder having a higher quaternary amine concentration was added to the core layer (Example 4). The preferred option is to add a combination of softener/debonder to core layer which allows the softener to migrate to surface layers and adjust chemical bonding in the dry layer to control product lint level (Example 1).

The tissue of the present invention also exhibits an improved surface profile that provides for improved product consistency and fewer defects that may otherwise cause sheet breaks. Specifically, the roughness of tissue can be characterized using two values, Pa (Average Primary Amplitude) and Wc (Average Peak to Valley Waviness). Pa is a commonly used roughness parameter and is computed as the average distance between each roughness profile point and the meanline. Wc is computed as the average peak height plus the average valley depth (both taken as positive values) relative to the meanline. As described in more detail below, the tissue of the present invention is measured to have Pa and Wc values that are both low and relatively uniform compared to conventional TAD tissue products.

The below discussed values for Pa and Wc of the inventive tissue were determined using the following test procedures:

Pa and Wc Testing

Ten samples of each tissue to be tested were prepared, with each sample being a 10 cm by 10 cm strip. Each sample was mounted and held in place with weights. Each sample was placed into a Marsurf GD 120 profilometer, available from Mahr Federal Instruments of Göttingen, Germany, and oriented in the CD direction. A 5 μm tip was used for the profilometer. Twenty scans were run on the profilometer per sample (ten in the forwards direction and ten in the backwards direction). The reverse scans were performed by turning the sample 180 degrees prior to scanning. Each scan covered a 30 mm length. The collected surface profile data was then transferred to a computer running OmniSurf analysis software, available from Digital Metrology Solutions, Inc. of Columbus, Ind., USA. The roughness profile setting for the OmniSurf software was set with a short filter low range of 25 microns and a short filter high range of 0.8 mm. The waviness profile setting of the OmniSurf software was set to a low range of 0.8 mm. For each sample, values for Pa (Average Primary Amplitude) and Wc (Average Peak to Valley Waviness) were calculated by the Omni Surf software. The calculated values of Pa and Wc for all twenty scans were averaged to obtain Pa and Wc values for each tissue sample. The standard deviation of the individual sample Pa and Wc values were also calculated.

The following examples are provided to further illustrate the invention.

Example 5

Two plies were produced, with each ply being equivalent to the three-layer structure formed in Example 1. The two plies were then embossed together to form a finished tissue product.

Comparative Example 2

Two plies were produced and embossed together as in Example 5, except that wet end additives were not used.

Table 2 shows the Pa and Pa standard deviation of several commercial products, Example 5, and Comparative Example 2 and 3.

TABLE 2

| SAMPLE | Pa | S.D | LOCATION PURCHASED | DATE PURCHASED |
|---|---|---|---|---|
| Charmin Basic | 82.58245 | 9.038986 | Wal-Mart - Anderson | July 2012 |
| Charmin Strong | 57.03765 | 8.130364 | Target - Anderson SC | July 2012 |
| Charmin Soft | 47.3826 | 9.72459 | Wal-Mart - Anderson | June 2012 |
| Charmin Soft | 79.33375 | 9.620164 | Wal-Mart - Anderson | January 2012 |
| Charmin Strong | 70.6232 | 11.32204 | Wal-Mart - Anderson | January 2012 |
| Cottonelle Clean Care | 100.9827 | 11.21668 | Wal-Mart - Anderson | January 2012 |
| Cottonelle Ultra Comfort Care | 90.5762 | 13.82119 | Wal-Mart - Anderson | January 2012 |
| Target UP & UP Soft and Strong | 65.9598 | 12.45098 | Target - Anderson SC | September 2012 |
| Comparative Example 2 | 86.2806 | 9.46203 | | |
| Example 5 | 41.66115 | 2.19889 | | |

Table 3 shows the Wc and Wc standard deviation of several commercial products, Example 5, and Comparative Example 2.

TABLE 3

| SAMPLE | Wc | S.D | LOCATION PURCHASED | DATE PURCHASED |
|---|---|---|---|---|
| Charmin Basic | 181.2485 | 31.50583 | Wal-Mart - Anderson | July 2012 |
| Charmin Strong | 163.4448 | 37.6021 | Target - Anderson SC | July 2012 |
| Charmin Soft | 147.54785 | 38.41011 | Wal-Mart - Anderson | June 2012 |
| Charmin Soft | 185.51195 | 30.68851 | Wal-Mart - Anderson | January 2012 |
| Charmin Strong | 216.1236 | 49.08633 | Wal-Mart - Anderson | January 2012 |
| Cottonelle Clean Care | 307.39355 | 34.06675 | Wal-Mart - Anderson | January 2012 |
| Cottonelle Ultra Comfort Care | 286.33735 | 51.90506 | Wal-Mart - Anderson | January 2012 |
| Target UP & UP Soft and Strong | 228.9568 | 59.57366 | Target - Anderson SC | September 2012 |
| Comparative Example 2 | 239.8652 | 54.96261 | | |
| Example 5 | 123.41615 | 14.97908 | | |

Tables 1 and 2 show the improved surface roughness characteristics of the inventive tissue as compared to commercially available products as well as similar tissue products that were not produced with wet end additives. Specifically, the tissue according to various exemplary embodiments of the present invention has an average Wc value of 140 or less, and more preferably 135 or less, with a Wc standard deviation (i.e., Waviness Uniformity) of 27 or less. Further, the tissue according to various exemplary embodiments of the present invention has an average Pa value of 50 or less, with a Wc standard deviation (i.e., Amplitude Uniformity) of 8 or less.

As known in the art, the tissue web is subjected to a converting process at or near the end of the web forming line to improve the characteristics of the web and/or to convert the web into finished products. On the converting line, the tissue web may be unwound, printed, embossed and rewound. According to an exemplary embodiment of the invention, the paper web on the converting lines may be treated with corona discharge before the embossing section. This treatment may be applied to the top ply and/or bottom ply. Nano cellulose fibers (NCF), nano crystalline cellulose (NCC), micro-fibrillated cellulose (MCF) and other shaped natural and synthetic fibers may be blown on to the paper web using a blower system immediately after corona treatment. This enables the nano-fibers to adsorb on to the paper web through electro-static interactions.

As discussed, according to an exemplary embodiment of the invention, a debonder is added to at least the interior layer as a wet end additive. The debonder provides flexibility to the finished tissue product. However, the debonder also reduces the strength of the tissue web, which at times may result in sheet breaks during the manufacturing process. The relative softness of the tissue web results in inefficiencies in the rewind process that must be performed in order to correct a sheet break. Accordingly, as shown in FIG. 4, in an exemplary embodiment of the present invention, a switching valve 120 is used to control delivery of the debonder as a wet-end additive to the interior layer. In particular, when a sheet break is detected using, for example, conventional sheet break detection sensors, the switching valve 120 may be controlled to prevent further delivery of the debonder. This results in less flexibility and increased strength at the portion of the tissue web to be rewound, thereby allowing for a more efficient rewind process. Once the rewind process is completed, the switching valve may be opened to continue delivery of the debonder.

In addition to the use of a sheet break detection sensor, the switching valve 120 may also be controlled during turn up, the process whereby the tissue web is one transferred from on roll to another. The turn up process can result in higher stresses on the tissue web that normal operation, thus increasing the chance of sheet breaks. The switching valve 120 is turned off prior to turn up, thus increasing the strength of the tissue web. After the tissue web has begun winding on a new roll, the switching valve 120 is turned on again. The resulting roll of basesheet material thus has a section of higher strength tissue web at the center of the roll and may have a section of higher strength tissue on the outside of the roll. During finishing, the exterior section of higher strength tissue is removed and recycled. The interior section of higher strength tissue is not used to make a finished tissue. Thus, only the portion of the roll of basesheet tissue containing debonder is used to make finished tissue.

Now that embodiments of the present invention have been shown and described in detail, various modifications and improvements thereon will become readily apparent to those skilled in the art. Accordingly, the spirit and scope of the present invention is to be construed broadly and not limited by the foregoing specification.

What is claimed is:

1. A two-ply, through air dried tissue comprising an outer surface having at least one of an Average Peak to Valley Waviness of 140 microns or less or an Average Primary Amplitude of 50 microns or less.

2. The two-ply, through air dried tissue of claim 1, wherein the outer surface has an Average Peak to Valley Waviness of 140 microns or less and a Waviness Uniformity of 27 microns or less.

3. The two-ply, through air dried tissue of claim 1, wherein the outer surface has an Average Primary Amplitude of 50 microns or less and an Amplitude Uniformity of 8 microns or less.

4. A through air dried tissue having a bulk softness of less than 10TS7 and comprising an outer surface having an Average Peak to Valley Waviness of 140 microns or less.

5. The through air dried tissue of claim 4, wherein the outer surface has a Waviness Uniformity of 27 microns or less.

6. A through air dried tissue having a bulk softness of less than 10TS7 and comprising an outer surface having an Average Primary Amplitude of 50 microns or less.

7. The through air dried tissue of claim 6, wherein the outer surface has an Amplitude Uniformity of 8 microns or less.

8. A two-ply, through air dried tissue comprising an outer surface having an Average Peak to Valley Waviness of 140 microns or less, a Waviness Uniformity of 27 microns or less, an Average Primary Amplitude of 50 microns or less and an Amplitude Uniformity of 8 microns or less.

9. The two-ply, through air dried tissue of claim 8, wherein the tissue has a bulk softness of less than 10TS7.

10. The two-ply, through air dried tissue of claim 8, wherein the outer surface has an Average Peak to Valley Waviness of 135 microns or less.

11. The two-ply, through air dried tissue of claim 8, wherein the tissue has a lint value of 7.5 or greater.

12. The two-ply, through air dried tissue of claim 8, wherein the tissue has a softness of at least 90.

13. The two-ply, through air dried tissue of claim 8, wherein the tissue has a caliper of less than 650 microns.

* * * * *